US005134112A

United States Patent [19]

Kanto et al.

[11] Patent Number: 5,134,112

[45] Date of Patent: Jul. 28, 1992

[54] HEAT TRANSFER SHEET

[75] Inventors: Jumpei Kanto; Hiroshi Eguchi; Hideaki Sato; Minoru Furuse; Mineo Yamauchi, all of Tokyo, Japan

[73] Assignee: Dai Nippon Insatsu Kabushiki Kaisha, Japan

[21] Appl. No.: 601,791

[22] PCT Filed: Mar. 6, 1990

[86] PCT No.: PCT/JP90/00285

§ 371 Date: Dec. 7, 1990

§ 102(e) Date: Dec. 7, 1990

[87] PCT Pub. No.: WO90/10544

PCT Pub. Date: Sep. 20, 1990

[30] Foreign Application Priority Data

Mar. 7, 1989 [JP] Japan ..... 1-52847

[51] Int. Cl.[5] ..... B41M 5/035; B41M 5/26

[52] U.S. Cl. ..... 503/227; 428/195; 428/336; 428/480; 428/913; 428/914

[58] Field of Search ..... 8/471; 428/195, 913, 428/914, 323, 336, 480; 503/227

[56] References Cited

U.S. PATENT DOCUMENTS 4,895,830 1/1990 Takeda et al. ..... 503/227

FOREIGN PATENT DOCUMENTS 62-51489 3/1987 Japan ..... 503/227
62-251190 10/1987 Japan ..... 503/227
64-38235 2/1989 Japan ..... 503/227

*Primary Examiner*—Bruce H. Hess
*Attorney, Agent, or Firm*—Parkhurst, Wendel & Rossi

[57] ABSTRACT

The present invention provides a heat transfer sheet including a substrate film and a dye and binder-containing dye layer formed thereon, characterized in that the substrate film includes a polyester film and an adhesive layer is formed between the substate film and the dye layer. The adhesive layer is stretched simultaneously with the substrate film, while the adhesive layer remains formed on the substrate film. Such an adhesive layer can be made very thin and is very effective in preventing the dye layer from peeling off. Thus, the invention makes it possible to provide a heat transfer sheet which can impart a high density to the image with an improved heat efficiency.

11 Claims, No Drawings

HEAT TRANSFER SHEET

TECHNICAL FIELD

The present invention relates to a heat transfer sheet and, more particularly, to a heat transfer sheet which is advantageously applicable to a heat transfer system using a sublimable (or thermally transferable) dye, effectively prevents a dye layer from peeling off during heat transfer, and can impart an excellent density to the resulting image.

BACKGROUND TECHNIQUE

As an alternative to printing techniques or systems heretofore used generally, there have been developed ink jet, heat transfer or other systems, which give improved monochromatic or full-color images in a simple and quick manner. Among these, the most excellent is a so-called sublimation type of heat transfer system using a sublimable dye, since it can successfully give a full-color image having an improved continuous gradation and color comparable to a color photograph.

In general, a heat transfer sheet used with the sublimation type of heat transfer system includes a substrate film such as a polyester film which is provided on one side with a dye layer containing a sublimable dye and on the other side with a heat-resistant layer to prevent a thermal head from sticking to the substrate film.

The surface of the dye layer of such a heat transfer sheet is overlaid on an imageable or image-receiving sheet including an image-receiving layer comprising a polyester resin. With a thermal head, the heat transfer sheet is then heated from its back side in an imagewise manner to pass the dye of the dye layer into the imageable sheet, thereby forming a desired image.

The heat transfer system is greatly advantageous in that the density of the image can be controlled by the temperature of the thermal head. However, if the temperature of the thermal head is elevated for a further density increase, then a binder forming the dye layer softens and adheres to the imageable sheet, posing a problem that the heat transfer sheet is bonded to the imageable sheet. If worse comes to worst, the dye layer remains transferred onto the surface of the imageable sheet when it is released from the heat transfer sheet.

An increase in the density of the image may also be achieved by increasing the concentration of the dye in the dye layer. In this case, however, the same problems as mentioned just above arise, since there is a relative decrease in the proportion of the binder contained in the dye layer.

In order to solve such problems, it has been proposed to interpose between the substrate film and the dye layer an adhesive layer comprising an ordinary adhesive resin such as polyurethane or polyester. In general, such an adhesive layer has been formed by coating on the surface of the substrate film a coating solution in which the adhesive resin is dissolved or dispersed in a solvent, followed by drying.

The provision of such an adhesive layer, however, leads to other problems, as set out below:

(1) It is desired that the substrate film and adhesive layer be both reduced in thickness as much as possible in order to keep the sensitivity of the resulting heat transfer sheet in good condition. However, when the substrate film is on the order of, say, a few μm in thickness, it is not easy to coat an adhesive layer coating solution on its surface, making a coating thickness variation likely to occur.

(2) The adhesive layer should also preferably be reduced in thickness as much as possible. To this end, it is required to use a coating solution having a reduced content of solid matter. A problem with the use of such a coating solution, however, is that a large quantity of an organic solvent is consumed in forming the adhesive layer. To make matters worse, a considerable difficulty is encountered in forming a uniform adhesive layer as thin as 1 μm or less.

With the conventional techniques, therefore, it is still unsuccessful to prevent the dye layer from peeling off when the adhesive layer is thin. When the adhesive layer is thick, on the other hand, a sensitivity drop is unavoidable.

It is thus an object of this invention to provide a heat transfer sheet which successfully prevents the dye layer from peeling off at the time of heat transfer and can impart a high density to the image with an improved heat efficiency.

DISCLOSURE OF THE INVENTION

In order to solve the above-mentioned problems, the present invention provides a heat transfer sheet comprising a substrate film and a dye and binder-containing dye layer formed on the substrate sheet, characterized in that the substrate film comprises a polyester film, and an adhesive layer is formed between the substrate film and the dye layer. The adhesive layer is subjected to stretching simultaneously with the substrate film, while it remains formed on the substrate film.

According to one specific embodiment of this invention, the peel strength between the dye and adhesive layers is preferably at least 10 gf/cm, particularly at 20 gf/cm at 20° C., and at least 20 gf/cm, particularly at least 50 gf/cm at 100° C.

According to the present invention, it is possible to provide a very thin and uniform or even adhesive layer on the surface of a substrate film, even though it is on the order of a few μm in thickness, since the substrate film is provided on the surface with the adhesive layer after or simultaneously with its preparation and the substrate film and adhesive layer are simultaneously stretched to a given thickness. By using the thus obtained film as the substrate film of a heat transfer sheet, it is possible to impart a high density to the image with an improved heat efficiency, but without causing the dye layer to peel off at the time of heat transfer.

It is thus possible to effectively prevent the dye layer from peeling off even when its dye concentration is much increased. This introduces remarkable improvements in both the heat efficiency of the thermal head and the density of printing without causing the dye layer to peel off.

BEST MODE FOR CARRYING OUT THE INVENTION

The present invention will now be explained in greater detail with reference to its preferred embodiments.

Preferably, the substrate film of the heat transfer sheet according to this invention is a polyester film. Particular preference is given to a polyethylene terephthalate film or a polyethylene-2, 6-naphthalate film. The thickness of the substrate film should be in the range of 0.5 to 50 μm, preferably 3 to 10 μm, as measured after stretching.

Preferably, the adhesive layer to be provided on the surface of the substrate film is formed of a resin which shows a satisfactory adhesion to the substrate film and the dye layer alike, is insoluble in the organic solvent used in forming the dye layer, and is less likely to receive the dye from the dye layer due to heating at the time of heat transfer.

Resins lending themselves to forming such an adhesive layer include various aqueous resins heretofore widely used as adhesives. Particular preference is given to aqueous acrylic, polyurethane, polyester, polyamide and polybutadiene resins, which may be used alone or in combination with other resins.

In the present disclosure, the term "aqueous resin" is understood to include a resin rendered hydrophilic to such an extent that it remains insoluble in water and dispersed or emulsified in water as well as a water-soluble resin. Thus, even when the adhesive layer formed of the aqueous resin is very thin, it shows a satisfactory adhesion to the substrate film and the dye layer alike, and is less likely to receive the dye from the dye layer during heat transfer. It is noted, however, that the present invention is not limited to the aqueous resins as mentioned above.

The adhesive layer may be formed of the above-mentioned resin by coating curing or after preparing the substrate film by known techniques such as inflation or extrusion and before stretching. Alternatively, it may be formed by laminating a film comprising an adhesive resin on the substrate film and then cold or hot stretching the laminate, preferably followed by a heat treatment.

With such methods as mentioned just above, it is possible to form a relatively thick and uniform adhesive layer before stretching. It is thus possible to form a very uniform adhesive layer as thin as 1 μm or less on the surface of the stretched substrate film, even though it is very thin.

Too thick an adhesive layer gives rise to a drop is the sensitivity of the obtained heat transfer sheet and is most likely to receive the dye from the dye layer, while too thin an adhesive layer is poor in adhesion. Thus, the adhesive layer should have a thickness in the range of preferably at most 1 μm, more preferably 0.005 to 0.1 μm.

If required, the adhesive layer may be subjected on the surface to conventional surface treatments such as corona discharge, plasma, ultraviolet and flame treatments.

In the present invention, it is preferred that the peel strength between the dye layer and the adhesive layer be at least 10 gf/cm, particularly at least 20 gf/cm at 20° C., and at least 20 gf/cm, particularly at least 50 gf/cm at 100° C. To limit the peel strengths at two temperatures or 20° C. and 100° C. to specific ranges, as contemplated in this invention, is useful in preventing the dye layer from peeling off and improving the density of printing.

A peel strength less than 10 gf/cm at 20° C. is unpreferred for the following two reasons. One reason is that there arises a problem that the dye layer peels off and is transferred to the image-receiving sheet, when the heat transfer sheet is released from the image-receiving sheet after heated by a thermal head and cooled down. Another reason is that when the heat transfer sheets are stored over an extended period while placed one upon another with the dye layer's surface in contact with the back surface, blocking takes place between both the surfaces, so that the dye layer is transferred to the back surface.

A peel strength less than 20 gf/cm at 100° C. is again unpreferred, because there arises a problem that the dye layer peels off and is transferred to the image-receiving sheet, when the heat transfer sheet is released from the image-receiving sheet after heated by a thermal head and cooled down.

In the present invention, the dye layer may optionally contain additional components such as surface active agents and inorganic fine particles.

The inorganic fine particles used may be those of calcium carbonate, titanium oxide, aluminium oxide, silica, barium carbonate, barium sulfate, talc, clay and so on. The addition of such inorganic fine particles in the range of, e.g., 0.01 to 10% by weight makes it possible to reduce the coefficient of friction of the surface of the adhesive layer and, consequently, obtain a substrate film whose processability is improved.

The surface active agent is added to keep the dispersibility of the aqueous resin or the inorganic fine particles in good condition. Preferable to this end are surface active agents such as an alkyl sulfate, an alkyl sulfonate, a fatty acid metallic soap, an alkylamine hydrochloride, a quaternary ammonium chloride, a glycerin fatty acid ester, as sorbitan fatty acid ester, a polyoxyethylene alkylphenyl ether and a polyoxyethylene fatty acid ester, which may be added in the range of 0.01 to 30% by weight.

In the present invention, the adhesive layer may contain still additional components such as antistatics, antiblocking agents and slip agents.

Preferably, the adhesive layer coating solution according to this invention should contain the above-mentioned aqueous resin in the range of 0.1 to 50% by weight.

The sublimable (thermally transferable) dye layer to be formed on the substrate film is a layer in which the dye is carried by any desired binder.

Dyes heretofore used for conventional heat transfer sheets are all usable in this invention. Although not critical, mention is preferably made of red dyes such MS Red G, Macrolex Red Violet R, Ceres Red 7B, Samaron Red HBSL and Resolin Red F3BS; yellow dyes such as Phorone Brilliant Yellow 6GL, PTY-52 and Macrolex Yellow 6G; and blue dyes such as Kayaset Blue 714, Vaccsolin Blue AP-FW, Phorone Brilliant Blue S-R and MS Blue 100.

Binder resins heretofore known in the art are all usable to carry such thermally transferable dyes as mentioned just above. For instance, use may be made of cellulosic resins such as ethyl cellulose, hydroxyethyl cellulose, ethylhydroxy cellulose, hydroxypropyl cellulose, methyl cellulose, cellulose acetate and cellulose acetate butyrate; vinylic resins such as polyvinyl alcohol, polyvinyl acetate, polyvinyl butyral, polyvinyl acetal, polyvinyl pyrrolidone and polyacrylamide; and polyester resins. Of these, preference is given to resins based on cellulose, acetal, butyral and polyester. Particularly preferable binders are polyvinyl acetal and cellulose triacetate resins, because they are so well-compatible with dyes that even when the weight ratio of the dye/binder in the dye layer formed lies at 0.1 or more, preferably 1 or more, more preferably 2–5, the dye is less likely to precipitate or crystallize in the dye layer. Accordingly, the dye layer can be made thin enough to increase its heat sensitivity and the image of the transferred image.

The dye layer of the heat transfer sheet according to this invention is basically constructed from the foregoing components, but may contain various additives so far known in the art, if required.

Preferably, such a dye layer may be formed by dissolving or dispersing the foregoing sublimable and binder resin together with other desired components in a suitable solvent to prepare a dye layer coating material or ink. Then, the coating material or ink is coated on the adhesive layer or an adhesion-stabilized layer thereon, followed by drying.

It is desired that the thus formed dye layer be about 0.1 to 50 μm, preferably about 0.4 to 2.0 μm in thickness and contain the sublimable dye in an amount of 5 to 90% by weight, preferably 10 to 70% by weight based on its weight.

The heat transfer sheet according to this invention may well serve as such. However, it is preferred that the dye layer be provided on the surface with an anti-blocking or release agent. In addition, the heat transfer recording sheet of this invention may be provided on the back side with a heat-resistant layer for preventing the heat of a thermal head from having an adverse influence upon it.

The image-receiving sheet used to form an image with the heat transfer sheet of this invention is not critical, if its recording surface can receive the foregoing dye. In the case of materials having no dye receptivity such as paper, metals, glass or synthetic resins, however, dye-receiving layers may be provided on their one sides.

The image-receiving materials which may not have a dye-receiving layer include fibers, woven fabrics, films, sheets or other forming comprising polyolefinic resins such as polypropylene; halogenated polymers such as polyvinyl chloride and polyvinylidene chloride; vinyl polymers such as polyvinyl acetate and polyacrylate ester; polyester type resins such as polyethylene terephthalate and polybutylene terephthalate; polystyrene type resins; polyamide type resins; copolymer resins such as those of an olefin such as ethylene or propylene with other vinyl monomers; inonomers; cellulosic resins such as cellulose diacetate; and polycarbonates. Particular preference is given to sheets or films comprising polyester or processed paper having a polyester layer.

In the present invention, even materials having no dye receptivity such as paper, metals or glass may be used as the image-receiving sheets. To this end, they may be coated on their recording surfaces with a solution or dispersion of such a dyeable resin, followed by drying. Alternatively, a film of such a resin may be laminated on the recording surfaces. Even in the case of a dye-receptive image-receiving sheet, its surface may be provided with a dye-receiving layer comprising a resin having a much more improved dye-receptivity.

The dye-receiving layer according to this invention, which may be formed of either a single material or plural materials, may contain various additives, provided that the object of this invention is achievable.

The dye-receiving layer may have any desired thickness, but is generally 5 to 50 μm in thickness. Such a dye-receiving layer is preferably in a continuously coated form, but may be in a discontinuously coated form obtained with a resin emulsion or dispersion.

Heat energy applicator means so far known in the art are all usable to apply a heat energy in carrying out heat transfer with the above-mentioned heat transfer sheet and image-receiving sheet. For instance, any desired image can be made by the application of a heat energy of about 5 to 100 mJ/mm$^2$ for a controlled period of time with the aid of recording hardware such as a thermal printer (e.g., Video Printer VY-100 commercialized by Hitachi, Ltd.).

According to this invention as described above, it is possible to provide a very thin and uniform or even adhesive layer on the surface of a substrate film, even though it is on the order of a few μm in thickness, by forming the adhesive layer on the surface of the substrate film after or simultaneously with its preparation, and simultaneously stretching the substrate film and adhesive layer to a predetermined thickness. According to this invention, it is also possible to provide a substrate film with an increased processability by incorporating fine particles into the adhesive layer, thereby reducing the coefficient of friction of its surface. By using the above-mentioned film as the substrate film of a heat transfer sheet, it is possible to impart a high density to the image with an improved heat efficiency but without causing the dye layer to peel off at the time of heat transfer.

It is thus possible to prevent the dye layer from peeling off even when its dye concentration is increased and, consequently, improve the heat efficiency of a thermal head and the density of printing remarkably without causing the dye layer to peel off.

The present invention will now be explained more illustratively with reference to the following examples and comparative examples wherein the "part" and "%" are given by weight, unless otherwise stated.

EXAMPLE 1

A hot melt of polyethylene terephthalate having an intrinsic viscosity of 0.64 was extruded onto a cooling drum at a temperature of 270°-300° C. to obtain a film having a thickness of 100 μm. This film was first axially stretched at 80° C. at a stretching ratio of 4, and then coated with an adhesive layer coating solution (1) of Table 5. Subsequently, the film was widthwise stretched at 110° C. at a stretching ratio of 4, and further heat-treated at 210° C. to obtain a biaxially stretched polyester film containing a 0.1 μm thick adhesive layer and having a total thickness of 6 μm.

After this substrate film had been provided on the back side with a heat-resistant layer a dye layer forming solution A of Table 6 was coated on the surface of the adhesive layer to a dry coverage of 1.2 g/m$^2$. Subsequent drying gave a heat transfer sheet according to this invention.

EXAMPLES 2-10

In place of the coating solutions of Ex. 1, the coating solutions set out in Table 5 were used under otherwise similar conditions, thereby obtaining heat transfer sheets according to this invention.

TABLE 1

| | Adhesive layer coating solutions | Coating solutions for forming adhesive layers | Thickness of adhesive layers (μm) |
|---|---|---|---|
| Ex. 2 | (2) | (A) | 0.05 |
| Ex. 3 | (3) | (A) | 1.0 |
| Ex. 4 | (4) | (A) | 0.3 |
| Ex. 5 | (5) | (A) | 0.1 |
| Ex. 6 | (6) | (A) | 0.005 |
| Ex. 7 | (7) | (A) | 0.1 |
| Ex. 8 | (1) | (B) | 0.1 |
| Ex. 9 | (4) | (B) | 0.05 |

TABLE 1-continued

| | Adhesive layer coating solutions | Coating solutions for forming adhesive layers | Thickness of adhesive layers (μm) |
|---|---|---|---|
| Ex. 10 | (6) | (B) | 0.2 |

EXAMPLE 11

A hot melt of polyethylene-2, 6-naphthalate was extruded at 280°-320° C. onto a cooling drum to obtain a film having a thickness of 100 μm. This film was first axially stretched at 110° C. at a stretching ratio of 4, and then coated with an adhesive layer coating solution (1) of Table 5. Subsequently, the film was widthwise stretched at 140° C. at a stretching ratio of 4, and further heat-treated at 240° C. to obtain a biaxially stretched polyethylene-2, 6-naphthalate film containing a 0.1 μm-thick adhesive layer and having a total thickness of 6 μm.

After this substrate film had been provided on the back side with a heat-resistant layer, a dye layer forming solution A of Table 6 was coated on the surface of the adhesive layer to a dry coverage of 1.2 g/m$^2$. Subsequent drying gave a heat transfer sheet according to this invention.

EXAMPLES 12-17

In place of the coating solutions of Ex. 11, the coating solutions set out in Table 5 were used under otherwise similar conditions, thereby obtaining heat transfer sheets according to this invention.

TABLE 2

| | Adhesive layer coating solutions | Coating solutions for forming adhesive layers | Thickness of adhesive layers (μm) |
|---|---|---|---|
| Ex. 12 | (1) | (A) | 0.05 |
| Ex. 13 | (2) | (A) | 0.05 |
| Ex. 14 | (4) | (A) | 0.2 |
| Ex. 15 | (1) | (B) | 0.3 |
| Ex. 16 | (3) | (B) | 0.1 |
| Ex. 17 | (6) | (B) | 0.1 |

COMPARATIVE EXAMPLE 1

A 6-μm thick polyethylene terephthatate film provided on the back side with a heat-resistant layer was coated with an adhesive layer coating solution (1) of Table 5, followed by drying at 100° C. for 10 minutes. Afterwards, a dye layer forming solution A of Table 2 was coated in the same manner as in Ex. 1, thereby obtaining a comparative heat transfer sheet.

COMPARATIVE EXAMPLES 2-10

In place of the coating solutions of Comparative Example 1, the coating solutions set out in Table 3 were used under otherwise similar conditions to obtain comparative heat transfer sheets.

TABLE 3

| | Adhesive layer coating solutions | Coating solutions for forming adhesive layers | Thickness of adhesive layers (μm) |
|---|---|---|---|
| Comp. Ex. 1 | (1) | (A) | 0.3 |
| Comp. Ex. 2 | (2) | (A) | 0.2 |
| Comp. Ex. 3 | (3) | (A) | 0.2 |
| Comp. Ex. 4 | (4) | (A) | 0.2 |
| Comp. Ex. 5 | (5) | (A) | 0.3 |
| Comp. Ex. 6 | (6) | (A) | 0.3 |
| Comp. Ex. 7 | (7) | (A) | 0.3 |

TABLE 3-continued

| | Adhesive layer coating solutions | Coating solutions for forming adhesive layers | Thickness of adhesive layers (μm) |
|---|---|---|---|
| Comp. Ex. 8 | (1) | (B) | 0.3 |
| Comp. Ex. 9 | (4) | (B) | 0.2 |
| Comp. Ex. 10 | (6) | (B) | 0.3 |

Comp. Ex.: Comparative Example

COMPARATIVE EXAMPLE 11

A 6-μm thick polyethylene-2, 6-naphthalate film provided on the back side with a heat-resistant layer was coated with an adhesive layer coating solution (1) of Table 5, followed by drying at 100° C. for 10 minutes. Afterwards, a dye layer forming solution A of Table 6 was coated in the same manner as in Ex. 1, thereby obtaining a comparative heat transfer sheet.

COMPARATIVE EXAMPLES 12-16

In place of the coating solutions of Comparative Example 1, the coating solutions set out in Table 4 were used under otherwise similar conditions to obtain comparative heat transfer sheets.

TABLE 4

| | Adhesive layer coating solutions | Coating solutions for forming adhesive layers | Thickness of adhesive layers (μm) |
|---|---|---|---|
| Comp. Ex. 12 | (4) | (A) | 0.2 |
| Comp. Ex. 13 | (6) | (A) | 0.2 |
| Comp. Ex. 14 | (1) | (B) | 0.2 |
| Comp. Ex. 15 | (2) | (B) | 0.3 |
| Comp. Ex. 16 | (5) | (B) | 0.3 |

TABLE 5

(Composition of adhesive layer coating solutions)

| | Composition of adhesive layer coating solutions | |
|---|---|---|
| CS1 | Acrylic resin (Jurymer AT-M918 made by Nippon Junyaku K.K.) | 4 parts |
| | Polyester resin (Polyester WR-901 made by Nippon Gosei Kagaku K.K.) | 2 parts |
| | Melanine resin (Nikarak MS-11 made by Sanwa Chemical Co., Ltd.) | 2 parts |
| | Calcium carbonate | 1 part |
| | Surfactant (NS208 made by Nippon Yushi K.K.) | 1 part |
| | Water | 90 parts |
| CS2 | Acrylonitrile-butadiene copolymer (Nipol 1581 made by Nippon Zeon K.K.) | 4 parts |
| | Polyester resin (Finetex ES-670 made by Dai Nippon Printing Co., Ltd.) | 4 parts |
| | Calcium Carbonate | 1 part |
| | Surfactant (NS208 made by Nippon Yushi K.K.) | 1 part |
| | Water | 90 parts |
| CS3 | Polyolefin (Chemibar S-120 made by Mitsui Petrochemical Industries, Ltd.) | 3 parts |
| | Polyester resin (Polyester WR-901 made by Nippon Gosei Kagaku Kogyo K.K.) | 5 parts |
| | Calcium carbonate | 1 part |
| | Surfactant (NS208 made by Nippon Yushi K.K.) | 1 part |
| | Water | 90 parts |
| CS4 | Polyurethane resin (Mercy 545 made by Toyo Polymer Co., Ltd.) | 2 parts |
| | Acrylic resin (Primal B-85 made by Nippon Acryl Co., Ltd.) | 2 parts |
| | Melanine resin (Nikarak MS-11 made by Sanwa Chemical Co., Ltd.) | 2 parts |
| | Calcium carbonate | 3 parts |
| | Surfactant (NS208 made by Nippon Yushi k.k.) | 1 part |
| | Water | 90 parts |

TABLE 5-continued (Composition of adhesive layer coating solutions)

| | Composition of adhesive layer coating solutions | |
|---|---|---|
| CS5 | Polyvinylidene chloride resin (Sarane EX 2380 made by Asahi Chemical Co., Ltd.) | 3 parts |
| | Epoxy compound (EX314 made by Nagase Sangyo K.K.) | 2 parts |
| | Polyethyleneimine (P-1000 made by Nippon Shokubai K.K.) | 2 parts |
| | Calcium carbonate | 2 parts |
| | Surfactant (NS208 made by Nippon Yushi K.K.) | 1 part |
| | Water | 90 parts |
| CS6 | N-methylacrylamide resin (F30 made by Teikoku Kagaku K.K.) | 3 parts |
| | Aqueous polyester resin (Polyester WR-901 made by Nippon Gosei Kagaku Kagyo K.K.) | 2 parts |
| | Silane coupling agent (SH6020 made by Toray Silicone Co., Ltd.) | 2 parts |
| | Calcium carbonate | 1 part |
| | Surfactant (NS208 made by Nippon Yushi K.K.) | 1 part |
| | Water | 90 parts |
| CS7 | Polyurethane resin (Mercy 545 made by Toyo Polymer Co., Ltd.) | 3 parts |
| | Aqueous polyester resin (Polyester WR-901 made by Nippon Gosei Kagaku Kogyo K.K.) | 2 parts |
| | 1,6-hexamethylenediethylene urea (HDU made by Sogo Yakuhin Kogyo K.K.) | 1 part |
| | Calcium carbonate | 1 part |
| | Surfactant (NS208 made by Nippon Yushi K.K.) | 1 part |
| | Water | 90 parts |

CS: Coating Solution

TABLE 6

(Compositions for forming dye layers)

| | Compositions | |
|---|---|---|
| Coating Solution A | Solvent Blue 36 | 7 parts |
| | Polyvinylacetoacetal | 3.5 parts |
| | Methyl ethyl ketone | 45 parts |
| | Toluene | 44.5 parts |
| Coating Solution B | Solvent Blue 36 | 7 parts |
| | Cellulose triacetate | 3.5 parts |
| | Methylene chloride | 80.0 parts |
| | Ethanol | 9.5 parts |

Peel Strength Testing

A pressure of 5 kgf/cm$^2$ was applied to the dye layers of two samples of each of the examples and comparative examples from above and below the heat-resistant layers for 5 seconds to fuse them together completely. Afterwards, the fused samples were cut to a 25-mm wide band whose T-type peel strength was measured at 20° C. and 100° C.

The adhesion was estimated by the following ranks. The T-type peel strength was measured according to JISK 6854.

| Adhesion | Peel Strength |
|---|---|
| ⊙ | higher than 50 gf/cm, or the substrate broken or the dye layer suffered a cohesive failure |
| ○ | 20 gf/cm to less than 50 gf/cm |
| Δ | 10 gf/cm to less than 20 gf/cm |
| X | less than 10 gf/cm |

Transfer Recording Testing

Each of the heat transfer sheets according to the examples and comparative examples was overlaid on the image-receiving sheet containing a dye-receiving layer comprising a polyester resin, while the dye layer was located in opposition to the dye-receiving layer. Then, thermal head recording was carried out from the back side of the heat transfer sheet at a head voltage of 12.0 V and a printing rate of 33.3 msec/line for a printing time of 16.0 msec/line.

The recorded images were visually estimated.

○: The dye layer did not peel off with a clear development of colors.

Δ: Less than 10% of the dye layer peeled off and was transferred to the image-receiving sheet, making the image partially dim.

x: More than 10% of the dye layer peeled off and was transferred to the image-receiving sheet, making the image partially dim.

The results are reported in Tables 7 and 8.

TABLE 7

| | Peel Strength Testing | | Transfer Recording testing |
|---|---|---|---|
| | 20° C. | 100° C. | |
| Ex. 1 | ⊙ | ○ | ○ |
| Ex. 2 | ○ | Δ | Δ |
| Ex. 3 | ○ | ○ | ○ |
| Ex. 4 | ⊙ | ○ | ○ |
| Ex. 5 | Δ | Δ | Δ |
| Ex. 6 | ○ | ○ | ○ |
| Ex. 7 | ○ | ○ | ○ |
| Ex. 8 | ○ | ○ | ○ |
| Ex. 9 | ○ | ○ | ○ |
| Ex. 10 | ○ | ○ | ○ |
| Ex. 11 | ⊙ | ○ | ○ |
| Ex. 12 | ○ | ○ | ○ |
| Ex. 13 | ○ | Δ | Δ |
| Ex. 14 | ⊙ | ○ | ○ |
| Ex. 15 | ○ | ○ | ○ |
| Ex. 16 | ○ | ○ | ○ |
| Ex. 17 | ○ | ○ | ○ |

TABLE 8

| | Peel Strength Testing | | Transfer Recording testing |
|---|---|---|---|
| | 20° C. | 100° C. | |
| Comp. Ex. 1 | X | X | X |
| Comp. Ex. 2 | X | X | X |
| Comp. Ex. 3 | X | X | X |
| Comp. Ex. 4 | X | X | X |
| Comp. Ex., 5 | X | X | X |
| Comp. Ex. 6 | X | X | X |
| Comp. Ex. 7 | X | X | X |
| Comp. Ex. 8 | X | X | X |
| Comp. Ex. 9 | X | X | X |
| Comp. Ex. 10 | X | X | X |
| Comp. Ex. 11 | X | X | X |
| Comp. Ex. 12 | X | X | X |
| Comp. Ex. 13 | X | X | X |
| Comp. Ex. 14 | X | X | X |
| Comp. Ex. 15 | X | X | X |
| Comp. Ex. 16 | X | X | X |
| Comp. Ex. 17 | X | X | X |

INDUSTRIAL APPLICABILITY

The heat transfer sheets of this invention may be widely used as ink donor sheets used with heat transfer systems making use of thermal printing means such as a thermal head.

What is claimed is:

1. A heat transfer sheet for heat-induced sublimation transfer printing on an image-receiving sheet, comprising:

a substrate film comprising a polyester film;

a dye layer formed on said substrate film, said dye layer comprising a sublimable dye and a binder; and an adhesive layer formed between said substrate film and said dye layer, said adhesive layer comprising an aqueous resin selected from the group consisting of aqueous polyurethane resins, and aqueous polybutadiene resins, said adhesive layer being stretched simultaneously with said substrate film while said adhesive layer remains formed on said substrate film.

2. A heat transfer sheet as recited in claim 1, wherein said adhesive layer is stretched and heat-treated simultaneously with said substrate film while said adhesive layer remains formed on said substrate film.

3. A heat transfer sheet as recited in claim 1, wherein the peel strength between said dye layer and said adhesive layer is at least 10 gf/am at 20° C. and at least gf/cm at 100° C.

4. A heat transfer sheet as recited in claim 1, wherein the peel strength between said dye layer and said adhesive layer is at least 20 gf/cm at 20° C. and at least gf/cm at 100° C.

5. A heat transfer sheet as recited in claim 1, wherein said adhesive layer has a thickness ranging from 0.005 μm to 1 μm.

6. A heat transfer sheet as recited in claim 1, wherein a binder forming said dye layer comprises a polyvinyl acetal resin or a cellulosic resin.

7. A heat transfer sheet as recited in claim 6, wherein said adhesive layer further at least one material selected from the group consisting of a surface active agent and inorganic fine particles.

8. A heat transfer sheet as recited in claim 1, wherein said aqueous resin is obtained by dispersing or emulsifying in water a hydrophilic resin or a resin rendered hydrophilic to such an extent that it remains insoluble in water.

9. A heat transfer sheet as recited in claim 1, wherein said adhesive layer is formed by subjecting the substrate film to primary stretching, then forming an adhesive layer forming coating on the surface of said substrate film subjected to said primary stretching, and finally subjecting said coating to secondary stretching simultaneously with said substrate film subjected to the primary stretching.

10. A heat transfer sheet as recited in claim 1, wherein said substrate film comprises a polyethylene terephthalate film.

11. A heat transfer sheet as recited in claim 1, wherein said substrate film comprises a polyethylene-2, 6-naphthalate film.

* * * * *